US008978766B2

(12) United States Patent
Nellessen, Jr. et al.

(10) Patent No.: US 8,978,766 B2
(45) Date of Patent: Mar. 17, 2015

(54) TEMPERATURE COMPENSATED ACCUMULATOR

(75) Inventors: Peter Nellessen, Jr., Palm Beach Gardens, FL (US); Quangen Du, Fresno, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 612 days.

(21) Appl. No.: 13/231,716

(22) Filed: Sep. 13, 2011

(65) Prior Publication Data

US 2013/0061937 A1 Mar. 14, 2013

(51) Int. Cl.
*E21B 33/038* (2006.01)
*E21B 33/035* (2006.01)
*E21B 17/01* (2006.01)

(52) U.S. Cl.
CPC ..... *E21B 33/0355* (2013.01)
USPC ..... 166/336; 166/344; 166/345; 166/367; 60/398; 60/413; 138/31

(58) Field of Classification Search
CPC ..... E21B 21/08; E21B 33/0355; E21B 41/04; E21B 43/16; E21B 43/162; E21B 43/166; E21B 21/10
USPC ..... 166/344, 345, 367, 368, 363; 60/398, 60/413; 138/31
See application file for complete search history.

(56) References Cited

U.S. PATENT DOCUMENTS 28,248 A * 5/1860 Bickford
359,315 A * 3/1887 Cregier ..... 138/31
524,013 A * 8/1894 Worthington ..... 417/21
586,598 A * 7/1897 French ..... 60/418
781,113 A * 1/1905 Weems ..... 60/398
1,181,110 A * 5/1916 Carter ..... 91/178
1,259,393 A * 3/1918 Graham ..... 60/413
1,905,133 A * 4/1933 Bishop et al. ..... 91/355
2,193,736 A * 3/1940 Onions ..... 92/108
2,451,171 A * 10/1948 Mullen ..... 267/64.22
2,506,374 A * 5/1950 McMahon ..... 91/178
2,531,907 A * 11/1950 Daubenmeyer ..... 92/29
2,554,381 A * 5/1951 Patterson, Jr. ..... 114/268
2,579,840 A * 12/1951 Levy ..... 244/50
2,592,613 A * 4/1952 Snyder ..... 138/31

(Continued)

FOREIGN PATENT DOCUMENTS

WO 2009035945 A1 3/2009
WO 2009123466 A1 10/2009

(Continued)

*Primary Examiner* — Matthew Buck
*Assistant Examiner* — Edwin Toledo-Duran

(57) ABSTRACT

A temperature compensated accumulator and method for use thereof downhole in a well. The accumulator may include a housing with separate bulkhead and piston assemblies. Thus, one assembly may include a hydraulic fluid chamber separated from a gas precharge pressure chamber by a piston and the other assembly may include an ambient pressure chamber separated from an atmospheric chamber by another piston. Additionally a pressure relief and check valve assembly may be located at a pressure relief chamber between the other assembly sections. Thus, venting to or from the gas precharge pressure chamber may take place upon exposure to a predetermined decreased or elevated temperature so as to maintain a substantially constant precharge level for the accumulator, for example, in spite of dramatic changes in downhole temperatures.

16 Claims, 3 Drawing Sheets

(56) References Cited

U.S. PATENT DOCUMENTS

| | | | | | |
|---|---|---|---|---|---|
| 2,663,320 | A * | 12/1953 | Snyder | 138/31 |
| 2,703,108 | A * | 3/1955 | McCuistion | 138/31 |
| 2,720,220 | A * | 10/1955 | Gratzmuller | 138/31 |
| 2,721,446 | A * | 10/1955 | Bumb | 60/415 |
| 2,747,370 | A * | 5/1956 | Traut | 138/31 |
| 2,748,801 | A * | 6/1956 | McCuistion | 138/31 |
| 2,764,999 | A * | 10/1956 | Stanbury | 138/31 |
| 2,790,462 | A * | 4/1957 | Ashton | 138/31 |
| 2,937,663 | A * | 5/1960 | Ashton et al. | 138/31 |
| 3,174,505 | A * | 3/1965 | Bauer | 137/505.18 |
| 3,232,346 | A * | 2/1966 | Wakefield, Jr. | 166/344 |
| 3,436,914 | A * | 4/1969 | Rosfelder | 60/398 |
| 3,463,226 | A * | 8/1969 | Johnson | 166/351 |
| 3,602,303 | A * | 8/1971 | Blenkarn et al. | 166/360 |
| 3,640,299 | A * | 2/1972 | Nelson | 137/1 |
| 3,672,402 | A * | 6/1972 | Bloemer | 138/31 |
| 3,713,364 | A * | 1/1973 | Francia | 92/13.1 |
| 3,779,135 | A * | 12/1973 | Sugimura | 91/45 |
| 3,813,701 | A * | 6/1974 | Stevens | 4/362 |
| 3,837,354 | A * | 9/1974 | Farr | 137/118.06 |
| 3,912,227 | A * | 10/1975 | Meeker et al. | 254/271 |
| 3,918,498 | A * | 11/1975 | Schneider | 138/31 |
| 3,987,708 | A * | 10/1976 | Uhrich | 92/134 |
| 3,990,235 | A * | 11/1976 | Bauchet | 60/413 |
| 4,002,105 | A * | 1/1977 | Bell et al. | 92/62 |
| 4,041,707 | A * | 8/1977 | Spector | 60/641.14 |
| 4,043,352 | A * | 8/1977 | Simpson | 138/31 |
| 4,095,421 | A * | 6/1978 | Silcox | 60/398 |
| 4,098,082 | A * | 7/1978 | Packer | 60/413 |
| 4,187,682 | A * | 2/1980 | Shen | 60/413 |
| 4,193,264 | A * | 3/1980 | Takahashi et al. | 60/397 |
| 4,205,594 | A * | 6/1980 | Burke | 92/65 |
| 4,362,438 | A * | 12/1982 | Spink | 405/195.1 |
| 4,452,422 | A * | 6/1984 | Trassl | 251/25 |
| 4,649,704 | A * | 3/1987 | Marsh | 60/415 |
| 4,777,800 | A * | 10/1988 | Hay, II | 60/593 |
| 4,880,060 | A * | 11/1989 | Schwendemann et al. | 166/336 |
| 5,050,380 | A * | 9/1991 | Jonsson | 60/413 |
| 5,447,026 | A * | 9/1995 | Stanley | 60/372 |
| 5,624,105 | A * | 4/1997 | Runkel | 267/64.15 |
| 5,855,114 | A * | 1/1999 | Runesson | 60/413 |
| 5,857,647 | A * | 1/1999 | Jakubowski, Jr. | 244/137.4 |
| 6,035,634 | A * | 3/2000 | Tupper et al. | 60/477 |
| 6,202,753 | B1 * | 3/2001 | Baugh | 166/364 |
| 6,418,970 | B1 * | 7/2002 | Deul | 138/31 |
| 6,598,891 | B2 * | 7/2003 | Sakai | 280/124.161 |
| 6,729,130 | B1 * | 5/2004 | Lilleland | 60/413 |
| 6,834,680 | B2 * | 12/2004 | Baugh | 138/31 |
| 6,848,755 | B2 * | 2/2005 | Yuda et al. | 303/87 |
| 7,159,662 | B2 * | 1/2007 | Johansen et al. | 166/374 |
| 7,165,619 | B2 | 1/2007 | Fox et al. | |
| 7,287,595 | B2 * | 10/2007 | Johansen et al. | 166/321 |
| 7,520,129 | B2 * | 4/2009 | Springett | 60/398 |
| 7,628,207 | B2 | 12/2009 | Leonardi et al. | |
| 7,874,155 | B2 * | 1/2011 | McBride et al. | 60/645 |
| 7,926,501 | B2 * | 4/2011 | Springett et al. | 137/14 |
| 7,984,764 | B2 | 7/2011 | Leonardi et al. | |
| 8,002,041 | B2 | 8/2011 | Leonardi et al. | |
| 8,109,085 | B2 * | 2/2012 | McBride et al. | 60/413 |
| 8,220,773 | B2 * | 7/2012 | Gustafson | 251/1.1 |
| 8,234,862 | B2 * | 8/2012 | McBride et al. | 60/508 |
| 8,281,897 | B1 * | 10/2012 | Lugo et al. | 184/6.4 |
| 8,464,525 | B2 * | 6/2013 | Springett et al. | 60/398 |
| 8,468,815 | B2 * | 6/2013 | McBride et al. | 60/413 |
| 8,479,774 | B2 * | 7/2013 | Baugh | 138/31 |
| 8,522,546 | B2 * | 9/2013 | Gray, Jr. et al. | 60/552 |
| 8,567,185 | B1 * | 10/2013 | Theobald et al. | 60/413 |
| 8,602,046 | B2 * | 12/2013 | Eriksen | 137/15.05 |
| 2004/0050042 | A1 * | 3/2004 | Frazer | 60/413 |
| 2005/0022996 | A1 * | 2/2005 | Baugh | 166/363 |
| 2005/0155658 | A1 * | 7/2005 | White | 138/31 |
| 2005/0217845 | A1 * | 10/2005 | McGuire | 166/100 |
| 2007/0157612 | A1 * | 7/2007 | He | 60/413 |
| 2008/0022672 | A1 * | 1/2008 | He | 60/413 |
| 2008/0104951 | A1 | 5/2008 | Springett | |
| 2008/0185046 | A1 * | 8/2008 | Springett et al. | 137/14 |
| 2008/0245432 | A1 | 10/2008 | Lenz | |
| 2008/0267786 | A1 | 10/2008 | Springett et al. | |
| 2009/0013681 | A1 * | 1/2009 | Courtright | 60/327 |
| 2010/0155072 | A1 * | 6/2010 | Gustafson | 166/335 |
| 2010/0206389 | A1 | 8/2010 | Kennedy et al. | |
| 2011/0137471 | A1 | 6/2011 | Dailey, Jr. | |
| 2011/0147002 | A1 * | 6/2011 | Kotrla et al. | 166/363 |
| 2011/0314800 | A1 * | 12/2011 | Fong et al. | 60/398 |
| 2013/0068333 | A1 * | 3/2013 | Dorr et al. | 138/31 |
| 2013/0340871 | A1 * | 12/2013 | Busse et al. | 138/31 |

FOREIGN PATENT DOCUMENTS

| | | |
|---|---|---|
| WO | 2010017200 A3 | 2/2010 |
| WO | 2011068580 | 6/2011 |

* cited by examiner

TEMPERATURE COMPENSATED ACCUMULATOR

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

Accumulators are devices that provide a reserve of hydraulic fluid under pressure. Accumulators are used in, for example, hydraulically-operated systems where hydraulic fluid under pressure operates a piece of equipment or a device. The hydraulic fluid may be pressurized by a pump that maintains the high pressure required.

If the piece of equipment or the device is located a considerable distance from the pump, for example, a significant pressure drop can occur in the hydraulic conduit or pipe which is conveying the fluid from the pump to operate the device. Therefore, the flow may be such that the pressure level at the device is below the pressure required to operate the device. Consequently, operation may be delayed until such a time as the pressure can build up with the fluid being pumped through the hydraulic line. This result occurs, for example, with devices located in a body of water at great depth, such as with a subsea test tree ("SSTT") and blowout preventer ("BOP") equipment, which is used to shut off a wellbore to secure an oil or gas well from accidental discharges to the environment. Thus, accumulators may be used to provide a reserve source of pressurized hydraulic fluid for such types of equipment.

In addition, if the pump is not operating, or if no pump is used, accumulators can be used to provide the source of pressurized hydraulic fluid to enable the operation of the piece of equipment or device.

Accumulators conventionally include a compressible fluid, e.g., gas such as nitrogen, helium, air, etc., on one side of a separating mechanism in a pressure resistant container, and a substantially incompressible fluid (e.g., hydraulic oil) on the other side of the separating mechanism. When the hydraulic fluid is released from the accumulator and the system pressure drops below the pressure on the gas side of the separating mechanism, the separating mechanism will move in the direction of the hydraulic fluid side of the separating mechanism, displacing the stored hydraulic fluid into the piece of equipment or the device as required.

When temperature changes within an accumulator, the precharge gas pressure will increase with increasing temperature and decrease with decreasing temperature. Changes in gas pressure affect the usable fluid volume that an accumulator can deliver. A near constant precharge pressure under varying temperatures would produce a near constant usable volume of fluid delivered by the accumulator. Accumulators known in the art use two chambers, one gas precharge chamber and on operating hydraulic fluid chamber. One solution to the problem of cooling of the gas pressure charge, and its consequent pressure reduction, is addressed in U.S. Patent Application Publication No. 2005/0022996A1, filed by Baugh and entitled, Temperature Compensation Of Deepwater Accumulators. The design disclosed in the Baugh publication includes heating of the gas by subsea heating elements to increase the temperature of the accumulator pre-charge gas.

There continues to be a need for improved temperature compensated accumulators.

SUMMARY

A temperature compensated accumulator according to one aspect of the invention includes a generally cylindrical housing having a first longitudinal end and a second longitudinal end. Each longitudinal and having a port therein. The housing divided into three sections by two longitudinally spaced apart bulkheads. A first piston is disposed in the housing on one side of the first bulkhead. The first piston separates an hydraulic fluid chamber at a first longitudinal end of the housing and a gas precharge pressure chamber on the other side of the first piston. A second piston disposed in the housing on one side of the second bulkhead. The second piston separates an ambient pressure chamber at a second longitudinal end of the housing and an atmospheric chamber disposed between the second piston and the second bulkhead. A connecting rod disposed between the first and second pistons. A pressure relief valve and a check valve are in pressure communication between the gas precharge pressure chamber and a pressure relief chamber. The pressure relief chamber is defined between the first bulkhead and the second bulkhead. The pressure relief chamber includes a longitudinally movable pressure barrier. The pressure relief valve is set to a preselected value within a range of pressure safely containable by the housing. The pressure is barrier engageable with a stop feature on the connecting rod such that an increase in ambient chamber pressure compresses gas discharged into the relief chamber back into the gas precharge chamber through the check valve.

A method for operating an accumulator according to another aspect of the invention includes charging an hydraulic fluid chamber with hydraulic fluid and charging a gas precharge pressure chamber adjacent thereto and separated by a first piston to a selected precharge pressure. The gas precharge chamber is exposed to a temperature above that at which the charging was performed. Excess pressure in the gas precharge chamber is vented to a pressure relief chamber adjacent the gas precharge pressure chamber. The hydraulic fluid is released to operate a device. Ambient pressure outside the accumulator is used to compress the vented excess pressure back into the gas precharge chamber.

Other aspects and advantages of the invention will be apparent from the description and claims which follow.

DETAILED DESCRIPTION

Figure 1:
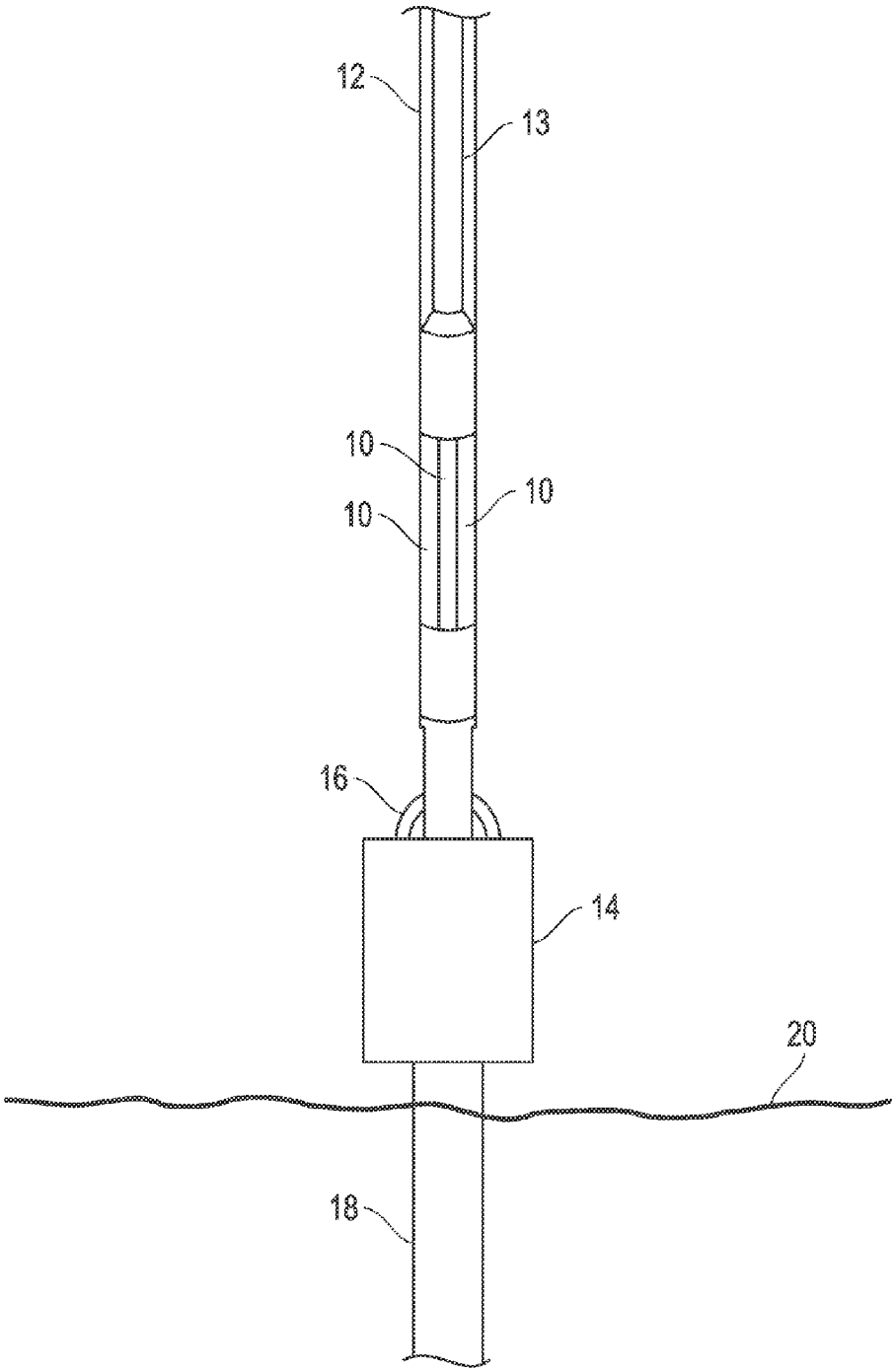
FIG. 1 is a schematic diagram of an example subsea wellbore with a test tree attached to the top thereof, and example accumulators according to the invention disposed in or about a riser pipe that extends to the water surface.

FIG. 1 shows an example subsea wellbore 18 drilled through formations below the bottom 20 of a body of water 20. The wellbore 18 may have installed at its upper end a subsea test tree ("SSTT") 14, shown only schematically for clarity of the illustration. The SSTT 14 may include various valves and controls (not shown separately) for controlling flow of fluids from the wellbore 18 and other functions. Hydraulic lines 16 connect to one or more accumulators 10 which may be disposed inside a riser 12 coupled above the SSTT 14. The riser 12 may extend to the surface wherein test control equipment (not shown) may be located, for example, on a floating drilling or production platform (not shown). The one or more accumulators 10 may be disposed in an annular space between the riser 12 and a production tubing 13 disposed inside the riser 12. As will be appreciated by those skilled in the art, the one or more accumulators 10 may provide hydraulic fluid under pressure to operate the various valves and controls in the SSTT 14.

Accumulator efficiency increases during operations over a wide range of temperatures if a constant gas pressure can be maintained. Specifically, the invention allows pressurization of the accumulator gas to the maximum working pressure of the accumulator housing without having to account for temperature changes during operations, which may cause the gas precharge pressure to increase over the maximum pressure for which the accumulator housing is designed. During operation, increasing operating temperatures (e.g., by hot subsurface fluids moving out of the wellbore 18 in FIG. 1) can heat the precharge gas and raise pressure to a value that may be above the rating of the accumulator housing. In order to compensate for the expected higher operating temperature, precharge gas pressure for accumulators known in the art is set at a lower value prior to installation, and this lower pressure affects the accumulator fluid working fluid volume when operating over a wide range of temperatures. The design of the present invention may produce a constant gas charge pressure as the accumulator temperature rises.

Figure 2:
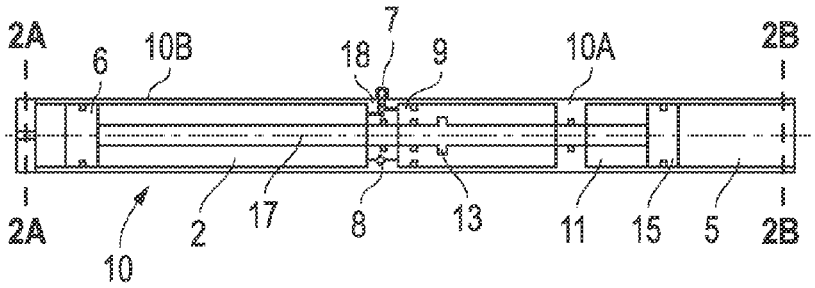
FIG. 2 shows a cross section of an example temperature compensated accumulator according to the invention.
Figure 2A:
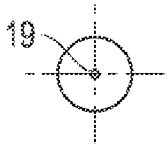
FIGS. 2A and 2B show, respectively, longitudinal ends of the housing for the accumulator shown in FIG. 2.
Figure 2B:
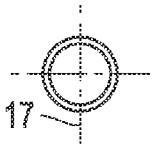

For purposes of the present description, the precharge gas may be nitrogen, a gas which is commonly used for charging accumulators. FIG. 2 shows a cross section taken through the centerline of a pressure balanced accumulator with temperature compensation components therein. A housing 10B such as may be made from stainless steel or similar high strength, pressure resistant material encloses the functional elements of the accumulator. The housing 10B may be generally cylindrically shaped, and include at one lateral end an hydraulic fluid chamber 1 defined between an end plate having a discharge port therein (see FIG. 2A for the cross sectional view of the end plate), and a first piston 6, which is movable longitudinally within the housing 10B and is pressure sealed against the inner wall thereof (illustrated in FIG. 2 such as by o-rings or similar seal element. The first piston 6 is connected on one side to a connecting rod 17.

The interior of the housing 10B may be separated into three hydraulically isolated sections by a bulkheads 10A and 112. The bulkheads may have an opening enabling a connecting rod 17 to pass freely therethrough, while maintaining a pressure seal (such as by using o-rings or similar sealing element. The other end of the connecting rod 17 is coupled to a second piston 15. One side of the second piston 15 is exposed to the external ambient pressure 5 and the other side is exposed to an atmospheric pressure chamber 4 or vacuum chamber. A third piston 9 or separator is movable both along the connecting rod 17 and within the interior wall of the housing 10B. The third piston 9 is sealed to the interior wall of the housing 10 and to the connecting rod 17, such as by using o-rings or similar seals. Motion of the third piston may under certain conditions be transferred by pressure bled off from chamber 2 and to the connecting rod 17 by a stop 113 formed in the connecting rod. The third piston 9 defines relief pressure chambers 3 and 3*a* between the bulkhead 10A and 112 and the third piston 9 inside the housing 10B.

The gas precharge pressure chamber 2 and the relief pressure chamber 3*a* are in fluid communication with each other through a pressure relief valve 7 and a check valve 8.

The accumulator 10 described above may enable the gas precharge pressure to be maintained at a safe level and relatively constant throughout all temperature conditions at a defined fluid system working pressure. When operating temperatures increase above the precharge state temperature, the pressure will increase in the gas precharge chamber 2. If the pressure therein exceeds the set operating pressure of the pressure relief valve 7 the excess pressure will be relieved into the pressure relief chamber 3*a* expanded from zero volume when piston 9 is compressed against the stop 113 due to the pressure generated by the excess pressure in chamber 2. The result is a near constant pressure in the pressure precharge chamber 2 as the accumulator temperatures increases. Thus, the accumulator design may be used for surface operations and for pressure balanced accumulators in subsea applications as shown in FIG. 1.

Preferably, the relief valve 7 and check valve 8 are installed in a suitably formed receptacle in the housing 10B of the accumulator 10 to allow the valves to be changed out without disassembling the accumulator 10.

After operating in a high temperature environment, the accumulator 10 may be returned to a low temperature condition by discharging the fluid and then recharging it again with fluid using a hydraulic pump. When the accumulator 10 hydraulic fluid is drained, e.g., to operate a device such as in the SSTT (FIG. 1) a check valve 8, connecting the gas precharge chamber 2, from the adjacent chamber 3*a*, allows gas to be transferred back to the gas precharge chamber 2. This check valve 8 may be integrated into the relief valve 7 or may be a separate valve. There may be a slight amount of nitrogen pressure still left in the relief chamber 3*a*, based on the operating pressure of the check valve 8. This small amount of gas pressure will not affect the operation of the accumulator.

Figure 3:
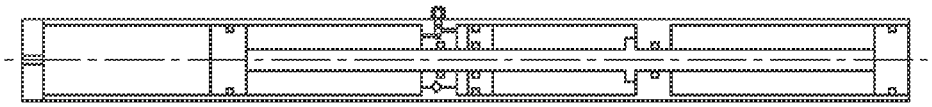
FIGS. 3, 4, 5 and 6 show the accumulator of FIG. 2 at different operating conditions.
Figure 4:
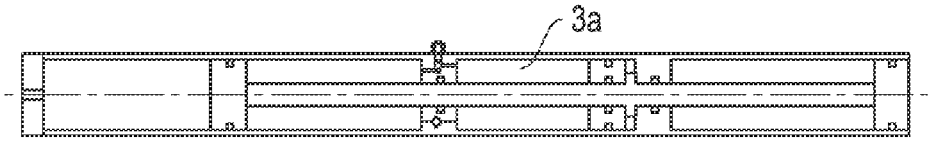
Figure 5:
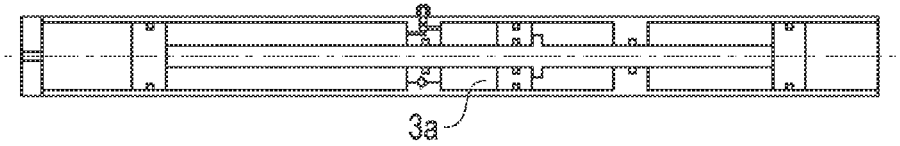
Figure 6:
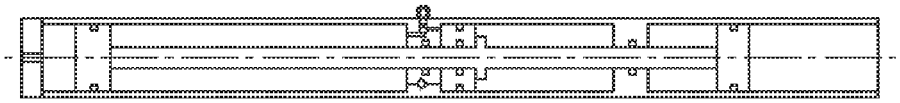

Refer to FIG. 3 that shows the typical operation of the proposed accumulator 10 during an operation in an environment where temperature increases above the precharge state temperature and then decreases. Specifically, this environment could be an operating case for a landing string operation where initial operations take place at a low temperature and then progress to flowback operations where well fluids can increase the accumulator temperature. Following flowback operations, the temperature may also decrease. The accumulator 10 design described herein provides a possible solution to the having usable hydraulic fluid pressure throughout the entire operation described. It has many other applications, such as on surface installed accumulators.

Referring to FIGS. 2 through 6, a description of the operation of an example accumulator 10 according to the invention may be as follows.

Operation A (FIG. 2) describes the state where the accumulator 10 is pre charged with gas (e.g., nitrogen) to the full working pressure at the surface. No hydraulic fluid is as yet present in the hydraulic fluid chamber. The gas (e.g., nitrogen) at pre-charge pressure is in disposed in a gas precharge pressure chamber 2. One atmosphere air pressure (or vacuum) is disposed in chamber 3. Air that may be at a pressure slightly lower than one atmosphere or a vacuum is applied to chamber 4. Under such conditions, the pressure relief valve 7 and the check valve 8 remain closed, and no pressure is transferred from the gas precharge chamber 2 to the relief chamber 3*a*. A sliding spacer 9 is pressed against a pressure bulkhead 112 by a stop feature 113 in the connecting rod 17.

Operation B (FIG. 3) describes the accumulator 10 state either on the surface or subsea after charging the hydraulic fluid chamber 1 with hydraulic fluid such as silicone oil. In such state, hydraulic fluid under pressure is present in the hydraulic fluid chamber 1. Pressure precharge gas (e.g., nitrogen) at maximum pressure relative to ambient pressure (precharge plus hydraulic pressure) is present in the gas pressure precharge chamber 2. Slightly higher than one atmosphere air (or vacuum) may be in the pressure relief chamber 3. One atmosphere air (or vacuum) is in a pressure balancing chamber 4. The relief valve 7 and check valve 8 remain closed. The sliding spacer 9 is pressed against a pressure bulkhead 112 so pressure relief chamber 3*a* has substantially no volume in this operating phase.

Operation C (FIG. 4) describes the accumulator 10 state after a temperature increase. The hydraulic fluid under pressure is present in hydraulic fluid chamber 1. The precharge gas at precharge pressure plus hydraulic pressure relative to ambient pressure is present in the gas precharge chamber 2. Some of the precharge pressure may be is bled off initially expanding the volume of the relief chamber 3*a*. The volume in the relief chamber 3 then decreases. One atmosphere air (or vacuum) is in atmospheric chamber 4. Once the pressure in the gas precharge chamber 2 falls below the operating pressure of the relief valve 7, the relief valve 7 then closes. Check valve 8 remains closed. The sliding spacer 9 is pushed near to or against the rod stop feature 113 by pressure of gas bled off from the gas precharge chamber 2 into the newly formed volume of the relief chamber 3*a*.

Operation D (FIGS. 5 and 6) describes the accumulator 10 state after a temperature decrease and during accumulator discharge of hydraulic fluid. As the hydraulic fluid is discharged to operate equipment in the SSTT (see 14 in FIG. 1), the hydraulic fluid pressure in the hydraulic fluid pressure chamber 1 decreases. Gas at the pre-charge pressure plus hydraulic pressure relative to ambient pressure is disposed in the precharge pressure chamber 2. The pressure in the relief chamber 3 increases due to compression. Air pressure in the atmospheric chamber 4 increases due to compression. The check valve 8 then opens to let gas from the relief chamber 3*a* return to the gas precharge pressure chamber 2. Pressure relief valve 7 is closed at this point. The sliding spacer 9 is pushed against the rod stop 113 and causes compression of the contents of the relief chamber 3*a*, thus enabling venting such pressure into the gas precharge pressure chamber 2.

After completing discharge of the hydraulic fluid, the accumulator 10 may be returned to operation A (FIG. 3).

Figure 7:
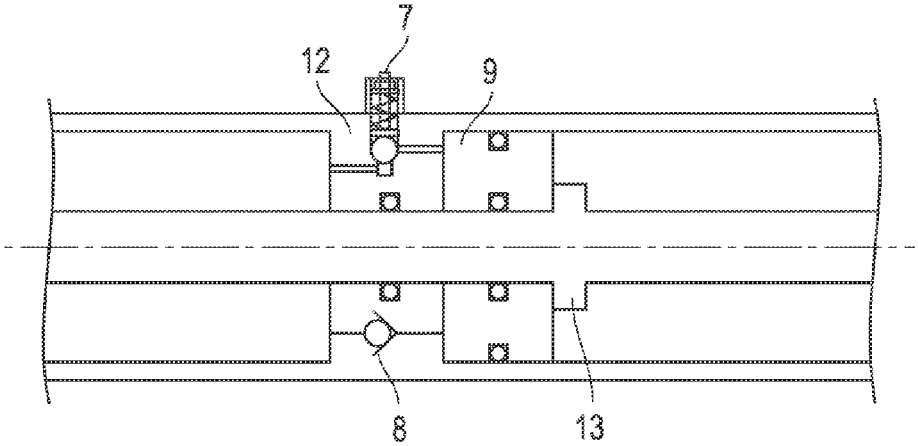
FIG. 7 shows a detailed view of a pressure relief valve and a check valve used in examples of an accumulator according to the invention.

FIG. 7 shows the detail of the relief valve 7 and check valve 8 installed in the bulkhead 112. As previously explained, using such configuration it may be possible to replace either or both the check valve 8 and the pressure relief valve 7 without the need to disassemble any other part of the accumulator.

It will be appreciated by those skilled in the art that in the example shown in FIG. 2, the first 6 and second 15 pistons may have the same cross sectional area exposed, respectively to the hydraulic fluid chamber 1 and the ambient pressure chamber 5. The respective chamber cross sectional areas defined by the internal diameter of the housing 10, which may be constant, and the external diameter of the connecting rod 17 may also be substantially the same, such that the pressure acting on the hydraulic fluid in the hydraulic fluid chamber 1 is substantially always equal to the ambient pressure plus the gas charge chamber 2 pressure. Thus, an example such as shown in FIG. 2 may be operated at any selected depth in the water and have a substantially constant working volume of hydraulic fluid.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A temperature compensated accumulator comprising:

a generally cylindrical housing having a first longitudinal end and a second longitudinal end, each longitudinal and having a port therein, the housing divided into three sections, including a centrally sealable pressure relief chamber, by two longitudinally spaced apart bulkheads;

a first piston disposed in the housing on one side of a first of the two bulkheads, the first piston separating a hydraulic fluid chamber and a gas precharge pressure chamber;

a second piston disposed in the housing on one side of a second of the two bulkheads, the second piston separating an ambient pressure chamber and an atmospheric chamber;

a connecting rod disposed between the first and second pistons; and a pressure relief valve and a check valve in pressure communication between the gas precharge pressure chamber and the pressure relief chamber, the pressure relief chamber defined between the first bulkhead and the second bulkhead, the pressure relief chamber including a longitudinally movable pressure barrier responsive to downhole temperature variations, the pressure relief valve set to a preselected value within a range of pressure safely containable by the housing, the pressure barrier engageable with a stop feature on the connecting rod such that an increase in pressure of the ambient pressure chamber compresses gas discharged into the pressure relief chamber back into the gas precharge pressure chamber through the check valve.

2. The accumulator of claim 1 wherein at least one of the pressure relief valve and the check valve is disposed in one of the bulkheads such that replacement of the at least one of the pressure relief valve and the check valve is enabled without disassembly of the accumulator.

3. The accumulator of claim 1 wherein the hydraulic fluid chamber is disposed at the first longitudinal end of the housing.

4. The accumulator of claim 3 wherein the hydraulic fluid chamber is in selectable fluid communication with a control on a subsea test tree.

5. The accumulator of claim 1 wherein the ambient pressure chamber is disposed at the second longitudinal end of the housing.

6. The accumulator of claim 1 wherein a cross sectional area of the first piston and the second piston are substantially equal, and wherein the hydraulic fluid chamber and the ambient pressure chamber are configured such that a pressure in the hydraulic fluid chamber is substantially equal to a sum of a pressure in the gas precharge pressure chamber and a pressure in the ambient pressure chamber.

7. A method for operating an accumulator, comprising:

charging a hydraulic fluid chamber with hydraulic fluid and charging a gas precharge pressure chamber adjacent thereto and separated by a first piston to a selected precharge pressure;

exposing the gas precharge pressure chamber to a temperature above that at which the charging was performed;

venting excess pressure in the gas precharge pressure chamber to a pressure relief chamber adjacent the gas precharge pressure chamber;

releasing the hydraulic fluid to operate a device; and using ambient pressure outside the accumulator to compress the vented excess pressure back into the gas precharge pressure chamber and wherein at least one of a pressure relief valve used to vent the excess pressure and a check valve used to return the vented excess pressure is disposed in one of a plurality of bulkheads in an accumulator housing such that replacement of the at least one of the pressure relief valve and the check valve is enabled without disassembly of the accumulator.

8. The method of claim 7 wherein the hydraulic fluid chamber and an ambient pressure chamber are configured such that a pressure in the hydraulic fluid chamber is substantially equal to a sum of a pressure in the gas precharge pressure chamber and a pressure in the ambient pressure chamber.

9. The method of claim 7 wherein the hydraulic fluid chamber is disposed at a first longitudinal end of an accumulator housing.

10. The method of claim 9 wherein the hydraulic fluid chamber is in selectable fluid communication with a control on a subsea test tree.

11. The method of claim 7 wherein an ambient pressure chamber is disposed at a second longitudinal end of an accumulator housing.

12. A temperature compensated accumulator used to operate at least one part of a subsea test tree comprising:

a generally cylindrical housing having a first longitudinal end and a second longitudinal end, each longitudinal and having a port therein, the housing divided into three sections, including a centrally sealable pressure relief chamber, by two longitudinally spaced apart bulkheads;

a first piston disposed in the housing on one side of a first of the two bulkheads, the first piston separating a hydraulic fluid chamber and a gas precharge pressure chamber;

a second piston disposed in the housing on one side of a second of the two bulkheads, the second piston separating an ambient pressure chamber and an atmospheric chamber;

a connecting rod disposed between the first and second pistons;

a pressure relief valve and a check valve in pressure communication between the gas precharge pressure chamber and the pressure relief chamber, the pressure relief chamber defined between the first bulkhead and the second bulkhead, the pressure relief chamber including a longitudinally movable pressure barrier responsive to downhole temperature variation, the pressure relief valve set to a preselected value within a range of pressure safely containable by the housing, the pressure barrier engageable with a stop feature on the connecting rod such that an increase in pressure of the ambient pressure chamber compresses gas discharged into the pressure relief chamber back into the gas precharge pressure chamber through the check valve; and wherein the hydraulic fluid chamber is in selectable fluid communication with at least one part of the subsea test tree.

13. The accumulator of claim 12 wherein at least one of the pressure relief valve and the check valve is disposed in one of the bulkheads such that replacement of the at least one of the pressure relief valve and the check valve is enabled without disassembly of the accumulator.

14. The accumulator of claim 12 wherein the hydraulic fluid chamber is disposed at the first longitudinal end of the housing.

15. The accumulator of claim 12 wherein the ambient pressure chamber is disposed at the second longitudinal end of the housing.

16. The accumulator of claim 12 wherein a cross sectional area of the first piston and the second piston are substantially equal, and wherein the hydraulic fluid chamber and the ambient pressure chamber are configured such that a pressure in the hydraulic fluid chamber is substantially equal to a sum of a pressure of the gas precharge pressure chamber and a pressure of the ambient pressure chamber.

* * * * *